US010145395B2

(12) United States Patent
Stuaan

(10) Patent No.: US 10,145,395 B2
(45) Date of Patent: Dec. 4, 2018

(54) SAFETY BLOCK

(71) Applicant: LAD Ag Industries, Inc., Garden Grove, IA (US)

(72) Inventor: Lucas Stuaan, Keota, IA (US)

(73) Assignee: LAD Ag Industries, Inc., Humeston, IA (US)

( * ) Notice: Subject to any disclaimer, the term of this patent is extended or adjusted under 35 U.S.C. 154(b) by 601 days.

(21) Appl. No.: 14/675,616

(22) Filed: Mar. 31, 2015

(65) Prior Publication Data

US 2015/0275934 A1 Oct. 1, 2015

Related U.S. Application Data

(60) Provisional application No. 61/972,629, filed on Mar. 31, 2014.

(51) Int. Cl.
*F15B 15/04* (2006.01)
*F15B 15/26* (2006.01)

(52) U.S. Cl.
CPC ..... *F15B 15/26* (2013.01); *F15B 15/04* (2013.01); *F15B 2015/268* (2013.01)

(58) Field of Classification Search
CPC ..... F15B 11/20; F15B 11/18; F15B 15/1404; F15B 15/1409; F15B 15/26
USPC ..... 74/469, 471 R, 479.01; 92/76
See application file for complete search history.

(56) References Cited

U.S. PATENT DOCUMENTS

| | | | |
|---|---|---|---|
| 3,003,473 | A | 10/1961 | Ottoson |
| 3,335,573 | A | 8/1967 | Ward |
| 3,397,620 | A | 8/1968 | Skelton et al. |
| 4,248,138 | A | 2/1981 | Akkerman |
| 4,276,814 | A | 7/1981 | Bass et al. |
| 4,807,855 | A | 2/1989 | Schuitema |
| 7,410,038 | B2 | 8/2008 | Kleinert et al. |
| 8,261,655 | B2 | 9/2012 | Teschke et al. |
| 8,408,326 | B2 | 4/2013 | Yuen et al. |
| 8,474,538 | B2 | 7/2013 | Wallace et al. |
| 2004/0113341 | A1 | 6/2004 | McConnell et al. |
| 2004/0255774 | A1 | 12/2004 | Hill |
| 2013/0187315 | A1 | 7/2013 | Kull et al. |

FOREIGN PATENT DOCUMENTS

| | | | |
|---|---|---|---|
| EP | 1036699 | A1 | 9/2000 |

OTHER PUBLICATIONS

Preliminary Report on Patentability, PCT/US2015/023728, dated Oct. 13, 2016 (Oct. 13, 2016).
International Searching Authority, PCT/US2015/023728, International Search Report and Written Opinion, dated Jun. 30, 2015 (Jun. 30, 2015).

*Primary Examiner* — Thomas E Lazo
*Assistant Examiner* — Daniel Collins
(74) *Attorney, Agent, or Firm* — Hamilton IP Law, PC; Jay R. Hamilton; Charles A. Damschen

(57) ABSTRACT

An illustrative embodiment of a safety block may include an actuator bracket pivotally engaged with a pivot arm. The actuator bracket may be configured to engage a master actuator having a first end moveable with respect to a second end. A secondary actuator may have a first end engaged with the actuator bracket and a second end engaged with the pivot arm such the secondary actuator may cause the pivot arm to move between a first position, in which first position the pivot arm prevents the master actuator from retracting, and a second position, in which second position the pivot arm allows the master actuator to retract.

8 Claims, 7 Drawing Sheets

SAFETY BLOCK

CROSS REFERENCE TO RELATED APPLICATIONS

This utility patent application claims the filing benefit of provisional Pat. App. No. 61/972,629 filed on Mar. 31, 2014, which is incorporated by reference herein in its entirety.

FIELD OF THE INVENTION

The present invention relates to the field of actuators equipment, and more specifically, to a safety device for preventing unwanted retraction of an actuator.

STATEMENT REGARDING FEDERALLY SPONSORED RESEARCH OR DEVELOPMENT

No federal funds were used to create or develop the invention herein.

REFERENCE TO SEQUENCE LISTING, A TABLE, OR A COMPUTER PROGRAM LISTING COMPACT DISK APPENDIX

N/A

BRIEF DESCRIPTION OF THE DRAWINGS

The accompanying drawings, which are incorporated in and constitute a part of this specification, illustrate embodiments and together with the description, serve to explain the principles of the safety block.

DETAILED DESCRIPTION

Element Listing

Figure 1A:
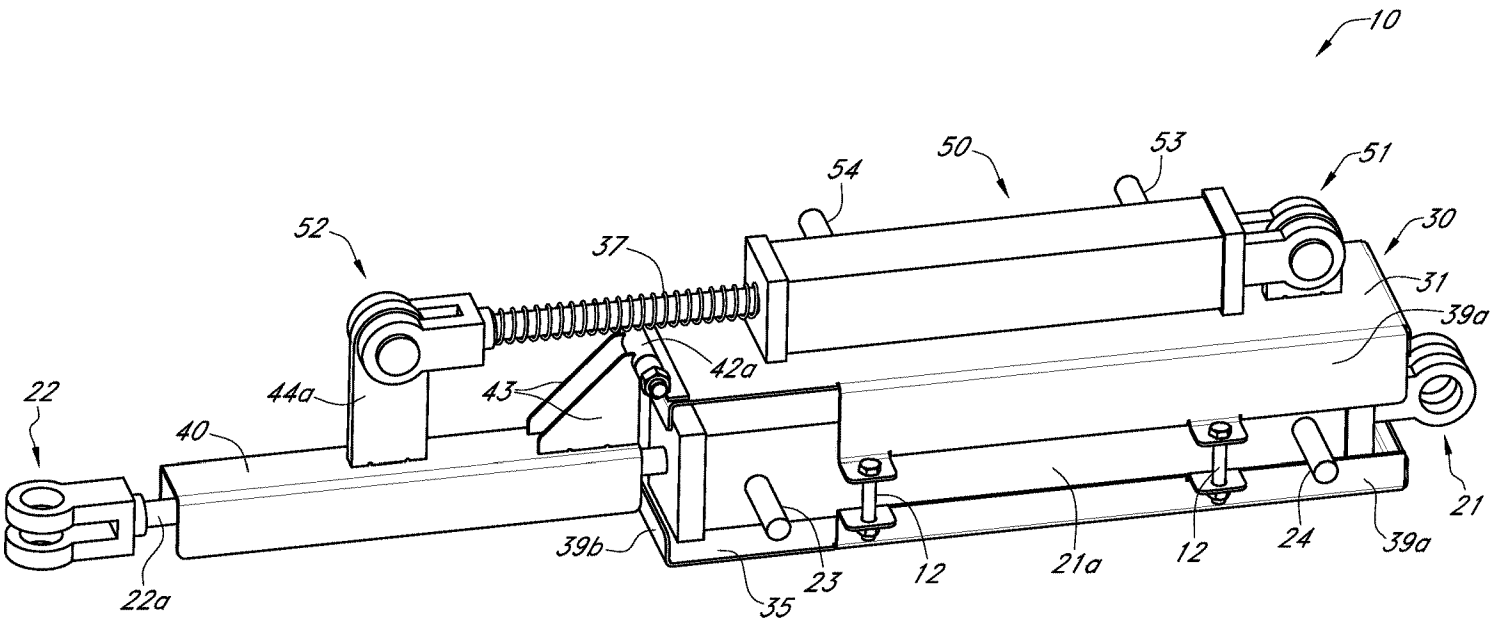
FIG. 1A provides a perspective view of a first illustrative embodiment of the safety block with the secondary actuator extended.

| Description | Element No. |
|---|---|
| Safety block | 10 |
| Fastener | 12 |
| Master Actuator | 20 |
| First end | 21 |
| Tube | 21a |
| Second end | 22 |

-continued

| Description | Element No. |
|---|---|
| Rod | 22a |
| First port | 23 |
| Second port | 24 |
| Actuator bracket | 30 |
| Top member | 31 |
| Plate | 32 |
| Bottom plate | 33 |
| Guide | 34 |
| Bottom member | 35 |
| Hinge | 36 |
| Spring | 37 |
| Mount | 38 |
| Pivot arm | 40 |
| Arm first end | 42 |
| Hinge mount | 42a |
| Brace | 43 |
| Arm second end | 44 |
| Secondary actuator mount | 44a |
| Spring mount | 44b |
| Secondary actuator | 50 |
| First end | 51 |
| Second end | 52 |
| First port | 53 |
| Second port | 54 |

DETAILED DESCRIPTION

Before the present safety block is disclosed and described, it is to be understood that the safety block is not limited to specific methods, specific components, or to particular implementations. It is also to be understood that the terminology used herein is for the purpose of describing particular embodiments only and is not intended to be limiting.

As used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not.

Throughout the description and claims of this specification, the word "comprise" and variations of the word, such as "comprising" and "comprises," means "including but not limited to," and is not intended to exclude, for example, other components, integers or steps. "Exemplary" means "an example of" and is not intended to convey an indication of a preferred or ideal embodiment. "Such as" is not used in a restrictive sense, but for explanatory purposes.

Disclosed are components that can be used to perform the disclosed safety block. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all safety blocks.

This applies to all aspects of this application including, but not limited to, components of a safety block. Thus, if there are a variety of additional components that can be added it is understood that each of these additional components can be added with any specific embodiment or combination of embodiments of the disclosed safety block 10.

The present safety block 10 may be understood more readily by reference to the following detailed description of preferred embodiments and the examples included therein and to the Figures and their previous and following description.

First and Second Illustrative Embodiments of a Safety Block

Figure 1B:
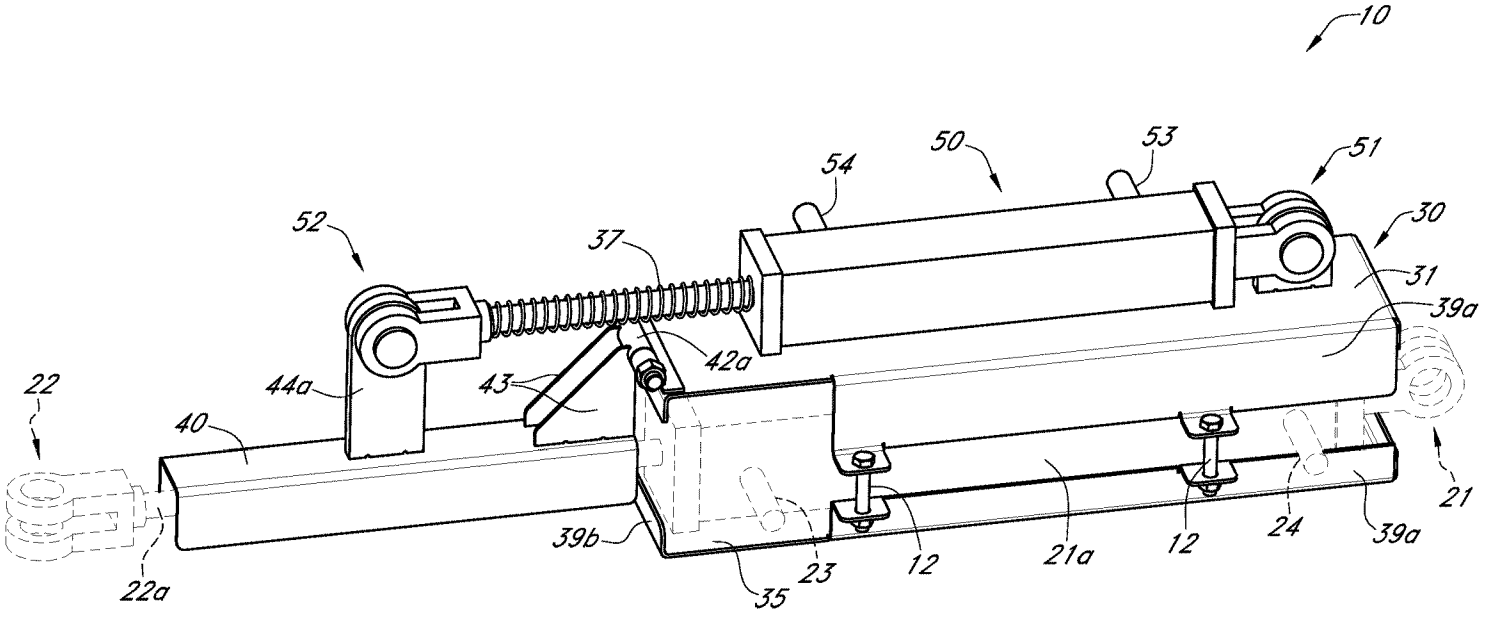
FIG. 1B provides a perspective view as that shown in FIG. 1A wherein the master actuator is shown via dashed lines.
Figure 2:
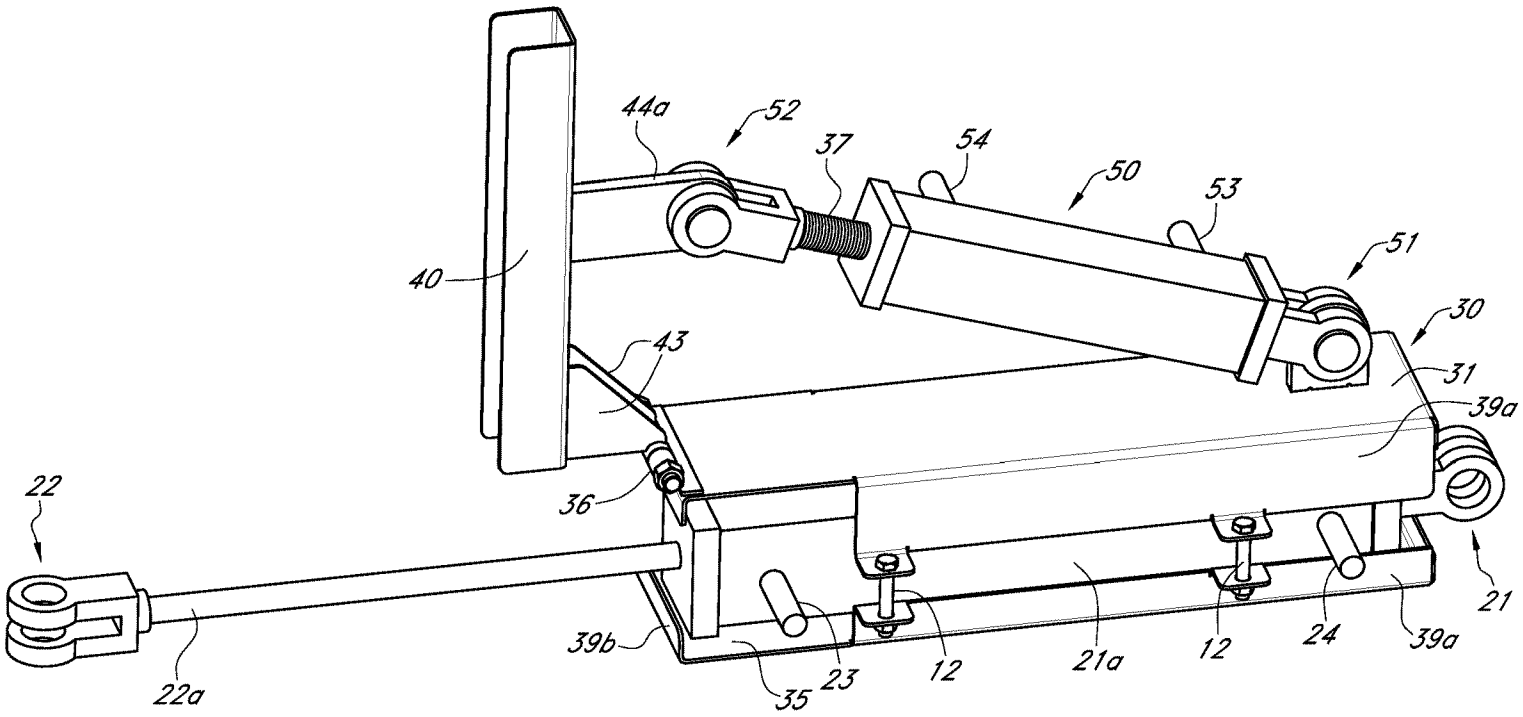
FIG. 2 provides a perspective view of the embodiment shown in FIGS. 1A and 1B with the secondary actuator retracted.

A perspective view of a first illustrative embodiment of a safety block 10 is shown in FIGS. 1A, 1B, and 2. The first illustrative embodiment of a safety block 10 may be advantageously engaged with a piece of equipment (not shown) having a master actuator 20, which master actuator 20 may be configured as a hydraulic actuator and may be powered by a pressurized hydraulic fluid. However, other embodiments of the safety block 10 may be configured for use with other types of master actuators 20, including but not limited to master actuators 20 that are pneumatic or electric. Furthermore, the first illustrative embodiment of a safety block 10 may be optimally used in a configuration in which the master actuator 20 is loaded (e.g., via gravity) when it is in the extend position, which extended position in shown in FIGS. 1A-2. Equipment that may have a master actuator 20 so configured includes but is not limited to row planters, discs, cultivators, tillers, ground-working equipment, etc. However, the scope of the safety block 10 is not limited in any way by the type of master actuator 20, equipment engaged with the master actuator 20, and/or configuration of either the master actuator 20 or equipment.

Still referring to FIGS. 1 and 1A, the master actuator 20 may include a first end 21 adjacent a tube 21*a* and a second end 22 adjacent a rod 22*a*. The second end 22 may be moveable with respect to the first end 21 in a manner well known to those of ordinary skill in the art. The master actuator 20 may also include a first port 23 and a second port 24 to provide entry/exit points for hydraulic fluid that may be used to power the master actuator 20. Fluid conduit 14 may be used to create a closed fluid circuit between the source of pressurized hydraulic fluid and the first and/or second ports 23, 24.

An actuator bracket 30 may be engaged with the master actuator 20 adjacent the tube 21*a*. In the illustrative embodiment the actuator bracket 30 may be positioned over the top and bottom surfaces and over a portion of each of the side surfaces of the master actuator 20. As shown for the first illustrative embodiment of a safety block 10 in FIGS. 1A-2, the actuator bracket 30 may be comprised of a top member 31 and a bottom member 35 engaged with one another via one or more fasteners 12 such that the actuator bracket 30 may be selectively engaged/disengaged from the master actuator 20 and such that the relative position of the actuator bracket 30 with respect to the master actuator 20 may be secured. In the illustrative embodiment, the fasteners 12 may be configured as corresponding threaded members (e.g., nuts and bolts), but any suitable fastener 12 may be used without limitation.

The top and/or bottom members 31, 35 may include one or more side curtains 39*a* that may be configured to cover a portion of either side of the master actuator 20. Portions of the top and/or bottom members 31, 35 may be formed without side curtains 39*a* and/or with relatively shorter side curtains 39*a* to provide access to certain parts of master actuator 20 (e.g., adjacent connection points for fluid conduit, electrical conduit, etc.). Additionally, the top and/or bottom members 31, 35 may include one or more end curtains 39*b* that may be configured to cover a portion of either end of the master actuator 20. Portions of the top and/or bottom members 31, 35 may be formed without end curtains 39*b* and/or with relatively shorter side curtains 39*b* to provide access to certain parts of the master actuator 20. However, other embodiments of the safety block 10 may have actuator brackets 30 differently configured without limitation, some of which embodiments are pictured and described herein.

A pivot arm 40 may be pivotally engaged with the actuator bracket 30 adjacent an interface between the tube 21*a* and the rod 22*a* via a hinge 36 in the actuator bracket 30 and a hinge mount 42*a* in the pivot arm 40 located at an arm first end 44. Generally, the pivot arm 40 may be configured as an elongate channel having three sides, but other configurations may be used with the safety block 10 without limitation. The pivot arm 40 may include one or more braces 43 positioned adjacent the hinge mount 42*a*. The braces 43 may serve to increase the robustness of the pivot arm 40 and/or may serve to offset the elevation of the pivot arm 40 with respect to the actuator bracket 30, which may be advantageous for master actuators 20 configured with a rod 22*a* having a smaller diameter than the diameter of the tube 21*a*. However, other types of braces 43 may be used without limitation.

A secondary actuator 50 may be engaged with the actuator bracket 30 at a first end 51 of the secondary actuator 50 and engaged with the pivot arm 40 at a second end 52 of the secondary actuator 50. In a manner similar to that for the master actuator 20, the second end 52 of the secondary actuator may be moveable with respect to the first end 51 thereof in a manner well known to those of ordinary skill in the art. The secondary actuator 50 may be configured as a hydraulic actuator and may be powered by a pressurized hydraulic fluid. However, other embodiments of the safety block 10 may be configured for use with other types of secondary actuators 50, including but not limited to secondary actuators 50 that are pneumatic or electric. The secondary actuator 50 may include a first port 53 and a second port 54 to provide entry/exit points for hydraulic fluid or other components that may be used to power the secondary actuator 50. Fluid conduit 14 may be used to create a closed fluid circuit between the source of pressurized hydraulic fluid and the first and/or second ports 53, 54. The actuator bracket 30 may include a mount 38, which mount 38 may be positioned adjacent the first end 21 to allow for engagement between the secondary actuator 50 and the actuator bracket 30. The pivot arm may include a secondary actuator mount 44*a* at an arm second end 44 to allow for engagement between the secondary actuator 50 and the pivot arm 40.

Generally, the secondary actuator 50 may be configured to actuate the pivot arm 40 between a first position and a second position. In the first position, the second end 52 of the secondary actuator 50 is extended away from the first end 51 (as shown in FIGS. 1 and 1A for the first illustrative embodiment of the safety block 10). In the first illustrative embodiment of the safety block 10, this may cause the pivot arm 40 to become generally parallel with respect to the longitudinal axis of both the master actuator 20 and secondary actuator 50. In this position, the pivot arm 40 may be positioned over the rod 22*a* of the master actuator 20 such that the pivot arm 40 may interfere with and/or prevent the rod 22*a* from moving in a direction toward the first end 21 of the master actuator 20. That is, in this position the pivot arm 50 may prevent the master actuator 20 from retracting.

In the second position, the second end 52 of the secondary actuator 50 may be retracted toward the first end 52 (as shown in FIG. 2 for the first illustrative embodiment of the safety block 10). In the first illustrative embodiment of the safety block 10, this may cause the pivot arm 40 to become angled with respect to the longitudinal axis of both the master actuator 20 and the secondary actuator 50. In this position, the pivot arm 40 may be positioned such that it does not interfere with and/or prevent the rod 22*a* from moving in a direction toward the first end 21 of the master actuator 20. That is, in this position the pivot arm 50 may allow the master actuator 20 to retract.

Figure 3:
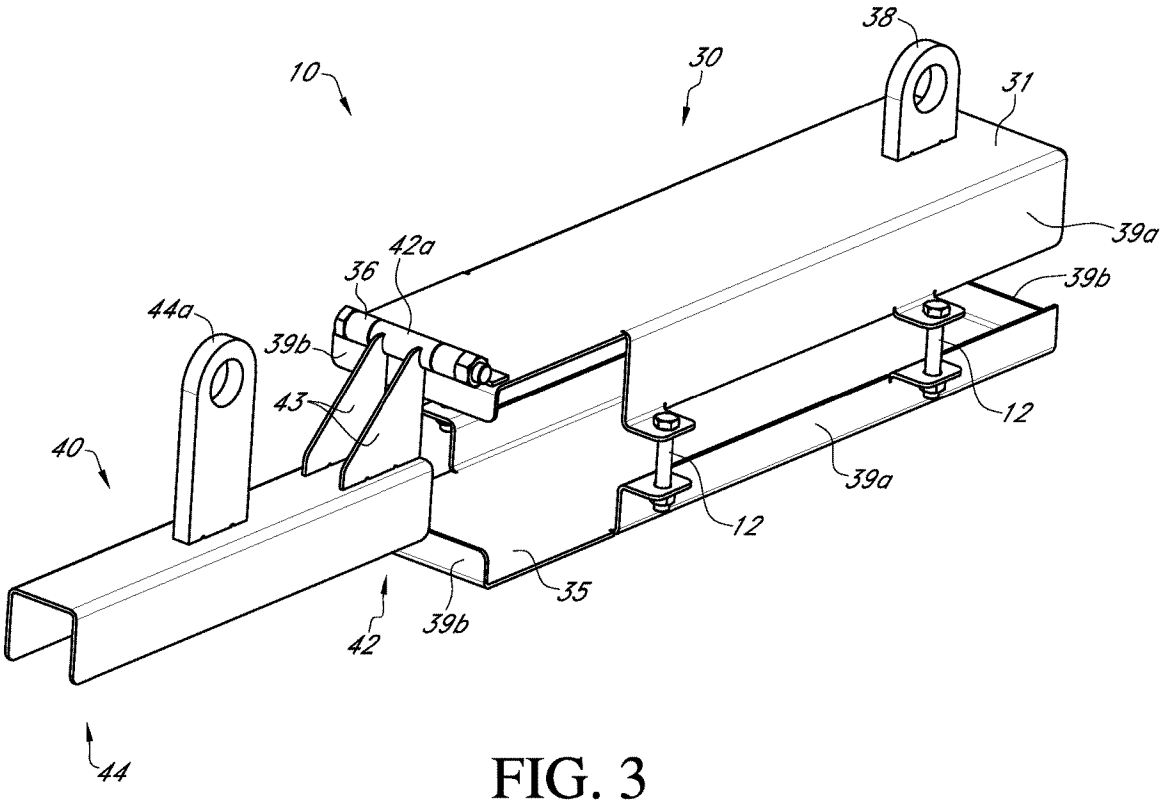
FIG. 3 provides a perspective view of a second illustrative embodiment of the safety block configured as it would be with a secondary actuator extended.
Figure 4:
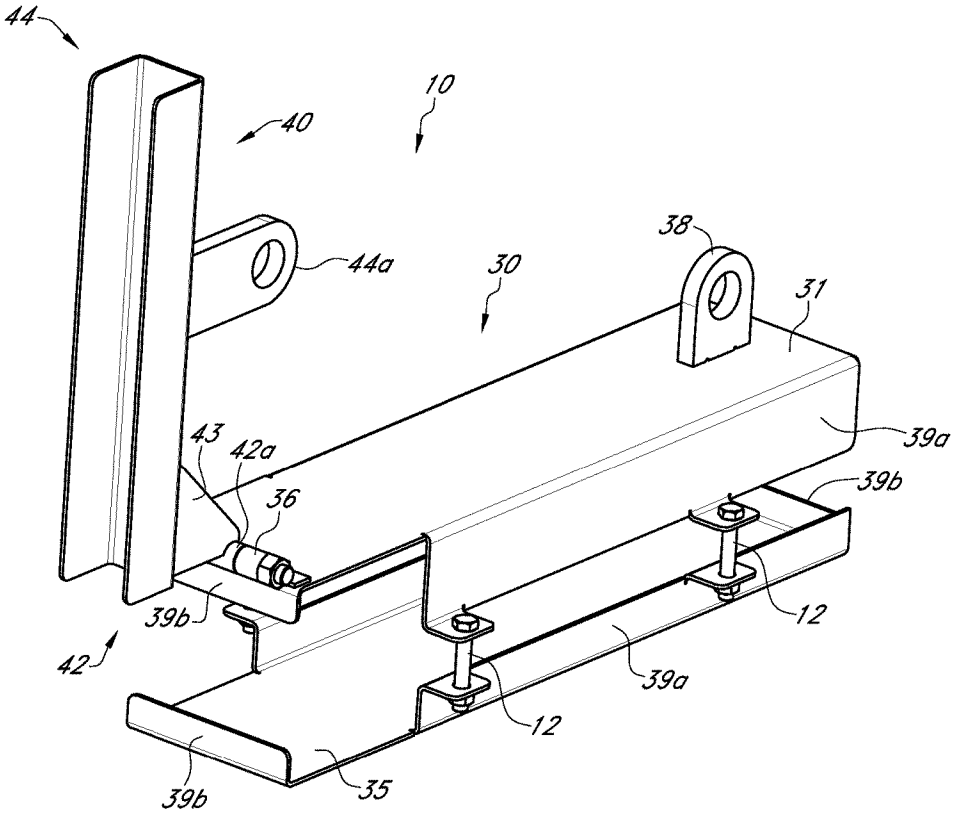
FIG. 4 provides a perspective view of a second illustrative embodiment of the safety block configured as it would be with a secondary actuator retracted.

A second illustrative embodiment of a safety block 10 according to the present disclosure is shown in FIGS. 3 and 4. This embodiment is similar to first illustrative embodiment of a safety block 10 as previously described and as shown in FIGS. 1A-2. As with the first illustrative embodiment, the second illustrative embodiment of a safety block 10 may include an actuator bracket 30 engaged with a portion of a master actuator 20. A pivot arm 40 may be pivotally engaged with the actuator bracket 30 such that the pivot arm may move at least between a first position as shown in FIG. 3 for the second illustrative embodiment and a second position as shown in FIG. 4 for the second illustrative embodiment.

As with the first illustrative embodiment of the safety block 10, when the pivot arm 40 of the second illustrative embodiment is positioned as shown in FIG. 3, the pivot arm 40 may interfere with and/or prevent the rod 22*a* from moving in a direction toward the first end 21 of the master actuator 20. That is, in this position the pivot arm 50 may prevent the master actuator 20 from retracting. Additionally, when the pivot arm 40 of the second illustrative embodiment is positioned as shown in FIG. 4, it does not interfere with and/or prevent the rod 22*a* from moving in a direction toward the first end 21 of the master actuator 20. That is, in this position the pivot arm 50 may allow the master actuator 20 to retract.

In the first or second illustrative embodiment of a safety block 10 a spring 37 may be positioned over a portion of the secondary actuator 50. Specifically, the spring 37 may be positioned between the first and second ends 51, 52 of the secondary actuator 50 such that the spring 37 biases the first end 51 away from the second end 52. In the event of failure of the secondary actuator 37, such a configuration may provide another layer of protection to the safety block 10, wherein the spring 37 biases the pivot arm 40 to the second position (FIGS. 2 and 4) and/or provides a force to lower the pivot arm 40 over the rod 22*a* of the master actuator 20 even in the event of failure of the secondary actuator 50.

As shown in FIGS. 2 & 4, retracting the secondary actuator 50 may cause the spring 37 to be compressed, such that a specific amount of potential energy is stored in the spring 37. When the secondary actuator 50 retracts (or if the amount of potential energy stored in the spring 37 is greater than the energy required to keep the secondary actuator 50 in the retracted state), a portion of this potential energy may be released. In the event of failure of the secondary actuator 50 and/or a component thereof, this release of potential energy may also result in the pivot arm 40 pivoting toward a portion of the master actuator 20 adjacent the rod 22*a*. Additionally, one or more torsion springs may be positioned on either side of the hinge mount 42*a* such that the torsion spring(s) also bias the pivot arm 40 in a direction toward the master actuator 20.

Generally, when the safety block 10 is in the first position, the pivot arm 40 may prevent the rod 22*a* of the master actuator 20 from moving toward the first end 21 of the master actuator 20 even in the event of catastrophic failure of the master actuator 20, first or second ports 23, 24, fluid conduit 14, and/or any other component of the system. It is contemplated that a user may so position the safety block 10 at any point when the user desires to prevent the master actuator 20 from retracting (e.g., during maintenance and/or transportation of equipment engaged with the master actuator 20). If the user desires to retract the master actuator 20 (e.g., during field use of equipment engaged with the master actuator 20), the user may simply move the safety block 10 to the second position. Although the illustrative embodiment of the safety block 10 may be especially useful for preventing unwanted movement of a master actuator 20 configured to be powered by pressurized hydraulic fluid, the scope of the present disclosure is not so limited and applies to a safety block 10 configured to prevent unwanted movement of a linear actuator, regardless of the means used to actuate either the linear actuator and/or secondary actuator 50. Accordingly, the safety block 10 may be configured for use with master actuators 20 that are pneumatically powered, electrically powered, and/or any other powering methods and/or structures without limitation.

It is contemplated that in one embodiment of the safety block 10, a hydraulic circuit for operating the master actuator 20 may be integrated with a hydraulic circuit for operating the secondary actuator 50 such that the secondary actuator 50 is configured to automatically extend (thereby moving the safety block 10 to the first position) whenever the master actuator 20 extends. And, subsequently, such that the secondary actuator automatically retracts (thereby moving the safety block 10 to the second position) whenever the master actuator 20 retracts. However, other configurations may be used without limitation.

Third Illustrative Embodiment of a Safety Block

Figure 5:
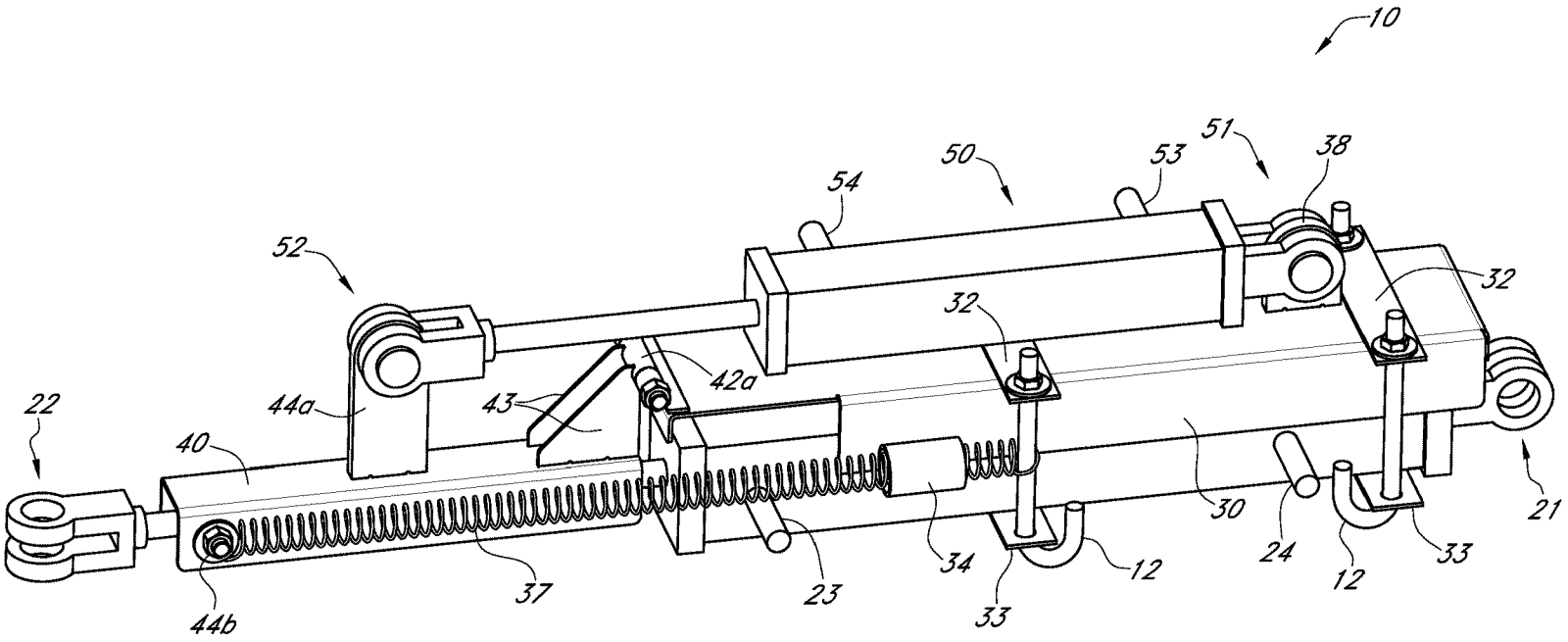
FIG. 5 provides a perspective view of a third illustrative embodiment of the safety block with the secondary cylinder extended.
Figure 6:
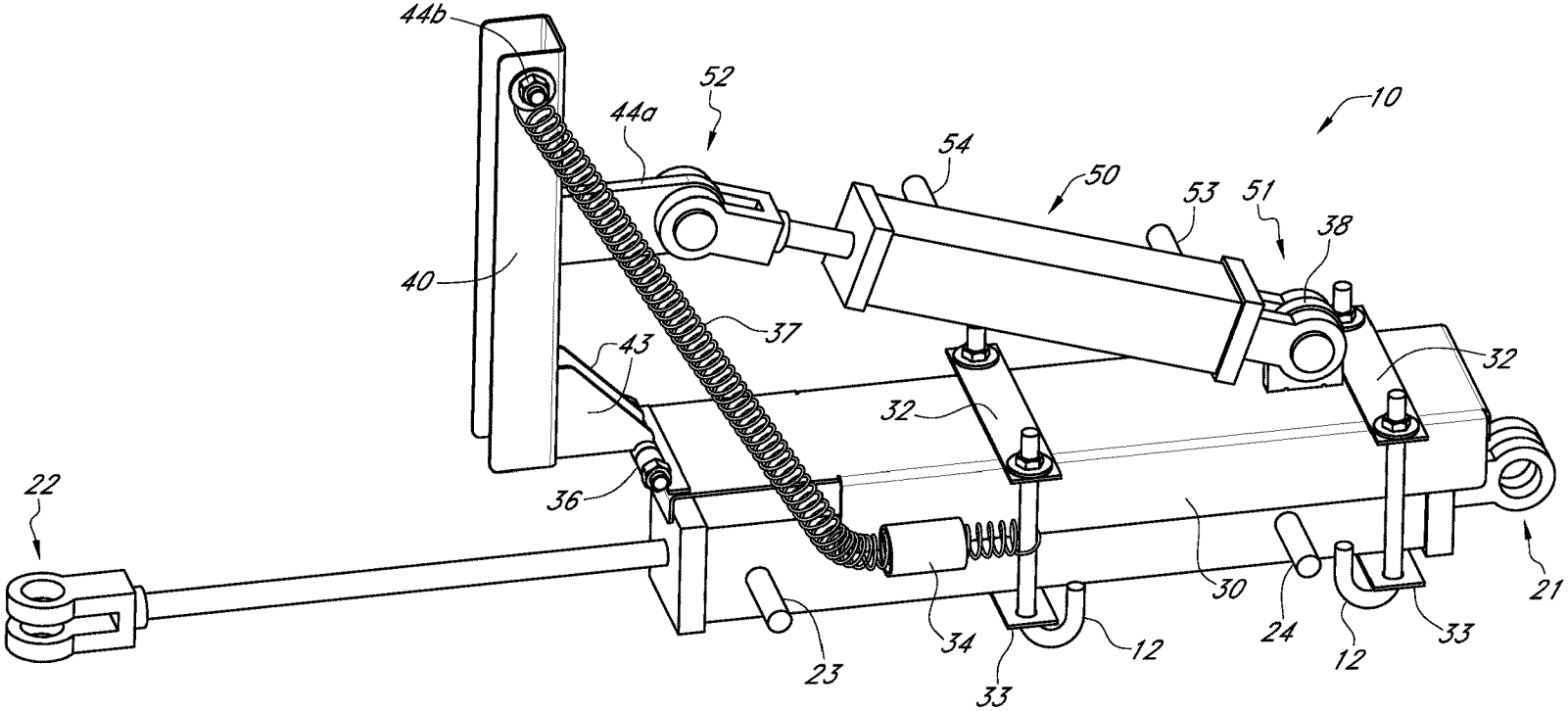
FIG. 6 provides a perspective view of the third illustrative embodiment of the safety blow with the secondary cylinder retracted.

In the third illustrative embodiment of a safety block 10, which is shown in FIGS. 5 and 6, the actuator bracket 30 may be engaged with the master actuator 20 via one or more plates 32 adjacent the top surface of the actuator bracket 30 cooperating with one or more bottom plates 33 adjacent the bottom surface of the master actuator 20. Each plate 32 may be engaged with the cooperating bottom plate 33 via one or more fasteners 12 such that the actuator bracket 30 may be selectively engaged/disengaged from the master actuator 20 and such that the relative position of the actuator bracket 30 with respect to the master actuator 20 may be secured. The fasteners 12 may be configured as any suitable fastener 12 without limitation.

A pivot arm 40 may be pivotally engaged with the actuator bracket 30 adjacent the end of the actuator bracket 30 corresponding to the end of the master actuator 30 from which the rod 22*a* protrudes via a hinge 36 in the actuator bracket 30 and a hinge mount 42*a* in the pivot arm 40, which hinge mount 42*a* may be located at an arm first end 44. Generally, the pivot arm 40 may be configured as an elongate channel having three sides, but other configurations may be used with the safety block 10 without limitation.

A secondary actuator 50 may be engaged with the actuator bracket 30 at a first end 51 of the secondary actuator 50 and engaged with the pivot arm 40 at a second end 52 of the secondary actuator 50. In a manner similar to that for the master actuator 20, the second end 52 of the secondary actuator may be moveable with respect to the first end 51 in a manner well known to those of ordinary skill in the art. The secondary actuator 50 may also include a first port 53 and a second port 54 to provide entry/exit points for hydraulic fluid that may be used to power the secondary actuator 50. Fluid conduit 14 may be used to create a closed fluid circuit between the source of pressurized hydraulic fluid and the first and/or second ports 53, 54. The actuator bracket 30 may include a mount 38, which mount 38 may be positioned adjacent the first end 21 to allow for engagement between the secondary actuator 50 and the actuator bracket 30. The pivot arm 40 may include a secondary actuator mount 44*a* at an arm second end 44 to allow for engagement between the secondary actuator 50 and the pivot arm 40.

Generally, the secondary actuator 50 may be configured to actuate the pivot arm 40 between a first position and a second position. In the first position, the second end 52 of the secondary actuator 50 is extended away from the first end 51 (as shown in FIG. 5 for the third illustrative embodiment of a safety block 10), which in this illustrative embodiment of the safety block 10 may cause the pivot arm 40 to become generally parallel with respect to the longitudinal axis of both the master actuator 20 and secondary actuator 50. In this position, the pivot arm 40 may be positioned over the rod 22*a* of the master actuator 20 such that the pivot arm 40 may interfere with and/or prevent the rod 22*a* from moving in a direction toward the first end 21 of the master actuator 20.

In the second position, the second end 52 of the secondary actuator 50 may be retracted toward the first end 52 (as shown in FIG. 6 for the third illustrative embodiment of a safety block 10), which in this illustrative embodiment of the safety block 10 may cause the pivot arm 40 to become angled with respect to the longitudinal axis of both the master actuator 20 and the secondary actuator 50. In this position, the pivot arm 40 may be positioned such that it does not interfere with and/or prevent the rod 22*a* from moving in a direction toward the first end 21 of the master actuator 20.

As with the first and second illustrative embodiments previously described, generally, when the safety block 10 is in the first position, the pivot arm 40 may prevent the rod 22*a* of the master actuator 20 from moving toward the first end 21 of the master actuator 20 even in the event of catastrophic failure of the master actuator 20, first or second ports 23, 24, fluid conduit 14, and/or any other component of the system. It is contemplated that a user may so position the safety block 10 at any point when the user desires to prevent the master actuator 20 from retracting (e.g., during maintenance and/or transportation of equipment engaged with the master actuator 20). If the user desires to retract the master actuator 20 (e.g., during field use of equipment engaged with the master actuator 20), the user may simply move the safety block 10 to the second position. Although the illustrative embodiments of the safety block 10 may be especially useful for preventing unwanted movement of a master actuator 20 configured to be powered by pressurized hydraulic fluid, the scope of the present disclosure is not so limited and applies to a safety block 10 configured to prevent unwanted movement of a linear actuator, regardless of the means and/or structure used to actuate either the linear actuator and/or secondary actuator 50. Accordingly, the safety block 10 may be configured for use with master actuators 20 that are pneumatically powered, electrically powered, and/or any other powering methods and/or structures without limitation.

As with the first and second illustrative embodiments, it is contemplated that in one aspect of the safety block 10, a hydraulic circuit for operating the master actuator 20 may be integrated with a hydraulic circuit for operating the secondary actuator 50 such that the secondary actuator 50 is configured to automatically extend (thereby moving the safety block 10 to the first position) whenever the master actuator 20 extends. And, subsequently, such that the secondary actuator automatically retracts (thereby moving the safety block 10 to the second position) whenever the master actuator 20 retracts. However, other configurations may be used without limitation.

The safety block 10 may be configured with a spring 37 to ensure that the pivot arm 40 remains in the desired position in the event of failure of the master actuator 20, secondary actuator 50, the hydraulic system thereof, or a component thereof. In the third illustrative embodiment, a first end of the spring 37 may be engaged with the actuator bracket 30 via one or more fasteners 12. A second end of the spring 37 may be engaged with the pivot arm 40 via a spring mount 44*b* positioned adjacent the arm second end 44. A guide 34 engaged with the actuator bracket 30 may be used to ensure the orientation of the spring 40 with respect to the master actuator 20 remains adequate to prevent retraction of the master actuator 20 when the safety block 10 is in the first position. Generally, the spring 37 may provide a biasing force to the pivot arm 40 to urge it toward the first position, and when in the first position, to urge the pivot arm 40 toward the rod 22*a*. Other structures and/or methods may be used to ensure that the pivot arm 40 remains in the desired position in the event of failure of the master actuator 20, secondary actuator 50, the hydraulic system thereof, or a component thereof without limitation.

The various elements of the safety block 10 may be separately formed and later engaged with one another (e.g., via mechanical fasteners, welding, etc.) or integrally formed with one another. The materials used to construct the safety block 10 and various elements thereof will vary depending on the specific application of the safety block, but it is contemplated that polymers, metals and there alloys, and/or combinations thereof will be especially useful for some applications. Accordingly, the above-referenced elements may be constructed of any material known to those skilled in the art or later developed, which material is appropriate for the specific application of the safety block 10, without departing from the spirit and scope of the safety block 10 as disclosed and claimed herein.

Having described the preferred embodiments, other features of the safety block 10 will undoubtedly occur to those versed in the art, as will numerous modifications and alterations in the embodiments as illustrated herein, all of which may be achieved without departing from the spirit and scope of the safety block 10 disclosed herein. Accordingly, the methods and embodiments pictured and described herein are for illustrative purposes only, and the scope of the present disclosure extends to all method and/or structures for preventing unwanted movement of a linear actuator. Furthermore, the methods and embodiments pictured and described herein are no way limiting to the scope of the safety block 10 unless so stated in the following claims.

It should be noted that the safety block 10 is not limited to the specific embodiments pictured and described herein, but is intended to apply to all similar apparatuses and methods for providing the various benefits and/or features of a safety block 10. Modifications and alterations from the described embodiments will occur to those skilled in the art without departure from the spirit and scope of the safety block 10. It is understood that the safety block 10 as disclosed herein extends to all alternative combinations of one or more of the individual features mentioned, evident from the text and/or drawings, and/or inherently disclosed. All of these different combinations constitute various alternative aspects of the safety block 10 and/or components thereof. The embodiments described herein explain the best modes known for practicing the safety block 10 and/or components thereof and will enable others skilled in the art to utilize the same. The claims are to be construed to include alternative embodiments to the extent permitted by the prior art.

The materials used to construct the safety block 10 and various elements thereof will vary depending on the specific application of the safety block 10, but it is contemplated that polymers, natural materials, metals and there alloys, and/or combinations thereof may be especially useful for some applications. Accordingly, the above-referenced elements may be constructed of any material known to those skilled in the art or later developed, which material is appropriate for the specific application of the safety block 10, without departing from the spirit and scope of the safety block 10 as disclosed and claimed herein.

While the safety block 10 has been described in connection with preferred embodiments and specific examples, it is not intended that the scope be limited to the particular embodiments set forth, as the embodiments herein are intended in all respects to be illustrative rather than restrictive.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that an order be inferred, in any respect. This holds for any possible non-express basis for interpretation, including but not limited to: matters of logic with respect to arrangement of steps or operational flow; plain meaning derived from grammatical organization or punctuation; the number or type of embodiments described in the specification.

It will be apparent to those skilled in the art that various modifications and variations can be made without departing from the scope or spirit. Other embodiments will be apparent to those skilled in the art from consideration of the specification and practice disclosed herein. It is intended that the specification and examples be considered as illustrative only, with a true scope and spirit being indicated by the following claims.

What is claimed is:

1. A safety block comprising:

a. an actuator bracket having a first end and a second end, wherein said actuator bracket is configured to engage a master actuator, and wherein said master actuator is further defined as being hydraulically powered;

b. a pivot arm having an arm first end and an arm second end, wherein said pivot arm is pivotally engaged with said actuator bracket at said first end of said actuator bracket;

c. a secondary actuator having a first end and a second end, wherein said first end of said second actuator is engaged with said actuator bracket via a mount, and wherein said second end of said actuator is engaged with said pivot arm via a secondary actuator mount;

d. wherein said secondary actuator is further defined as being hydraulically powered; and, e. wherein said actuator bracket is further defined as comprising a top member and a bottom member, wherein said top member and said bottom member are engaged with one another via a plurality of fasteners, and wherein said top member includes a side curtain.

2. The safety block according to claim 1 wherein said bottom member is further defined as comprising a side curtain.

3. The safety block according to claim 2 wherein said safety block further comprises a spring positioned around said secondary actuator, wherein said spring is configured to bias said secondary actuator against retraction.

4. A method of preventing unwanted retraction of an actuator, said method comprising:

a. engaging a safety block with said actuator, wherein said safety block comprises:

i. an actuator bracket having a first end and a second end, wherein said actuator bracket is configured to engage said master actuator, wherein said master actuator is further defined as being hydraulically powered, and wherein said actuator bracket is further defined as comprising a top member and a bottom member, wherein said top member and said bottom member are engaged with one another;

ii. a pivot arm having an arm first end and an arm second end, wherein said pivot arm is pivotally engaged with said actuator bracket at said first end of said actuator bracket, and wherein said pivot arm is pivotally offset with respect to said actuator bracket; and, iii. a secondary actuator having a first end and a second end, wherein said first end of said second actuator is engaged with said actuator bracket via a mount, wherein said second end of said actuator is engaged with said pivot arm via a secondary actuator mount, and wherein said secondary actuator is further defined as being hydraulically powered;

b. extending said secondary actuator such that said pivot arm is generally parallel with respect to said actuator bracket;

c. retracting said secondary actuator such that said pivot arm is angled with respect to said actuator bracket;

d. preventing a rod of said master actuator from retracting toward said actuator bracket via engagement between said rod and said pivot arm-; and, e. allowing said rod of said master actuator to retract toward said actuator bracket.

5. The method according to claim 4 wherein said top member and said bottom member are further defined as being engaged with one another via a plurality of fasteners.

6. The method according to claim 5 wherein said top member is further defined as comprising a side curtain.

7. The method according to claim 6 wherein said bottom member is further defined as comprising a side curtain.

8. The method according to claim 7 wherein said safety block further comprises a spring positioned around said secondary actuator, wherein said spring is configured to bias said secondary actuator against retraction.

* * * * *